US008387625B2

(12) United States Patent
Kawata et al.

(10) Patent No.: US 8,387,625 B2
(45) Date of Patent: Mar. 5, 2013

(54) ORAL TOBACCO PRODUCT

(75) Inventors: Norio Kawata, Tokyo (JP); Manabu Takeuchi, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/308,649

(22) Filed: Dec. 1, 2011

(65) Prior Publication Data

US 2012/0073588 A1 Mar. 29, 2012

Related U.S. Application Data

(63) Continuation of application No. PCT/JP2010/059670, filed on Jun. 8, 2010.

(30) Foreign Application Priority Data

Jun. 17, 2009 (JP) ..... 2009-144182

(51) Int. Cl.
*A24B 15/00* (2006.01)

(52) U.S. Cl. ..... 131/352; 156/192; 156/277; 156/278; 206/204; 206/205

(58) Field of Classification Search ..... None
See application file for complete search history.

(56) References Cited

U.S. PATENT DOCUMENTS

| | | | | |
|---|---|---|---|---|
| 3,865,664 | A * | 2/1975 | Neumann | 156/192 |
| D584,141 | S | 1/2009 | Smith et al. | |
| 2008/0029116 | A1 * | 2/2008 | Robinson et al. | 131/352 |

FOREIGN PATENT DOCUMENTS

| | | | |
|---|---|---|---|
| JP | 63-203572 | A | 8/1988 |
| JP | 2005-335309 | A | 12/2005 |
| WO | WO 2004/095959 | A1 | 11/2004 |
| WO | WO 2008/016520 | A2 | 2/2008 |

* cited by examiner

*Primary Examiner* — Richard Crispino
*Assistant Examiner* — Phu Nguyen
(74) *Attorney, Agent, or Firm* — Birch, Stewart, Kolasch & Birch, LLP

(57) ABSTRACT

An oral tobacco product which includes a tobacco pouch obtained by wrapping tobacco particles made from a tobacco material in a wrapper, the tobacco pouch allowing a user to take in tobacco components of the tobacco particles via saliva, when put in the user's mouth, and an outer wrapper individually wrapping the tobacco pouch therein. The outer wrapper has liquid impermeability and is provided with a lug for the user.

6 Claims, 5 Drawing Sheets

ORAL TOBACCO PRODUCT

CROSS REFERENCE TO RELATED APPLICATIONS

This application is a Continuation of PCT/JP2010/059670 filed on Jun. 8, 2010, which claims priority of Application No. 2009-144182 filed in Japan on Jun. 17, 2009, all of which are hereby expressly incorporated by reference into the present application.

TECHNICAL FIELD

The present invention relates to oral tobacco products which allow users to take in tobacco components via saliva.

BACKGROUND ART

Cigarettes have so far been popular as one of articles of taste. Recently, smokeless tobacco has been attracting attention because it can be used in a nonsmoking area such as in the cabin of an aircraft or in the passenger cars of a train.

Snus (SNUS), which is a kind of smokeless tobacco, includes shreds obtained by finely cutting a tobacco material, and a substantial amount of water is contained in the tobacco shreds. The user puts the tobacco shreds directly into his/her mouth to enjoy the flavor of tobacco and also to take in the tobacco components of the tobacco shreds via saliva. Specifically, snus can be classified into a loose type in which the tobacco shreds are not wrapped, and a portion type, or what is called a pouch type, in which the tobacco shreds are wrapped in a wrapper made of nonwoven fabric or the like. In the case of the pouch type snus, the user puts the snus in between the upper lip and the gum so that the tobacco components dissolving into the saliva may be taken into the body through the gum.

The tobacco shreds of snus contain a substantial amount of water as stated above, and therefore, while the pouch type snus is kept in storage, water containing the tobacco components is likely to ooze out. The ooze discolors the nonwoven fabric wrapper, not only making the snus itself look dirty but staining the things around the snus.

There have also been known oral tobacco products of pillow packaging type or blister packaging type in which a single dose of snus or a predetermined number of doses of snus are individually packaged (Patent Documents 1, 2 and 3). These tobacco products are configured such that the snus can be seen from outside.

PRIOR ART LITERATURE

Patent Documents

Patent Document 1: International Publication No. WO 2004/95959

Patent Document 2: U.S. Design Pat. No. 584141

Patent Document 3: International Publication No. WO 2008/16520

SUMMARY OF THE INVENTION

Problems to be Solved by the Invention

In the case of the blister packaging type tobacco product, however, when the user takes out the snus from the blister pack, the snus needs to be once put on the user's palm, possibly staining the user's hand with the tobacco components that have oozed out from the snus. Also, because of its bulkiness, the blister pack is not easy to keep or to carry.

Even in the pillow packaging type tobacco product, the tobacco components possibly ooze out to the outer surface of the outer wrapper. If this occurs, the user's hand is stained when the user takes out the snus from the outer wrapper.

An object of the present invention is to provide an oral tobacco product which is hygienic, looks nice, and yet is packaged in simple form.

Means for Solving the Problems

To achieve the above object, the present invention provides an oral tobacco product comprising: a tobacco pouch including tobacco particles made from a tobacco material, and a wrapper wrapping the tobacco particles therein, the tobacco pouch allowing a user to take in tobacco components of the tobacco particles via saliva when put in the user's mouth; and an outer wrapper individually wrapping the tobacco pouch therein, wherein the outer wrapper has liquid impermeability and is provided with a lug.

Specifically, the outer wrapper may have a packaging form of either twist wrapping type or fold wrapping type.

The tobacco pouch is individually wrapped in the outer wrapper, and therefore, when using the oral tobacco product, the user can hygienically take out the tobacco pouch without his/her fingers stained with the tobacco components that may have oozed to the outer surface of the tobacco pouch. Also, the ooze of the tobacco components does not appear on the outer surface of the outer wrapper, making the oral tobacco product look nice.

Further, the outer wrapper prevents evaporation of the flavor and water contained in the tobacco particles, whereby the quality of the tobacco particles can be maintained. When the used tobacco pouch is discarded, moreover, the outer wrapper can be used to wrap the used tobacco pouch.

Preferably, the outer wrapper is made of one of aluminum-deposited paper, laminated paper, and waxed paper. In this case, the outer wrapper not only protects the tobacco pouch from moisture but also satisfactorily prevents dissipation of the water and flavor from the tobacco pouch.

Advantageous Effects of the Invention

In the oral tobacco product of the present invention, the tobacco pouch containing tobacco particles is individually wrapped. Accordingly, when the oral tobacco product is handled, the user's hand is not stained and also the oral tobacco product has a hygienic appearance. Further, the outer wrapper serves to prevent evaporation of the flavor and water from the tobacco material.

MODE OF CARRYING OUT THE INVENTION

Figure 1:
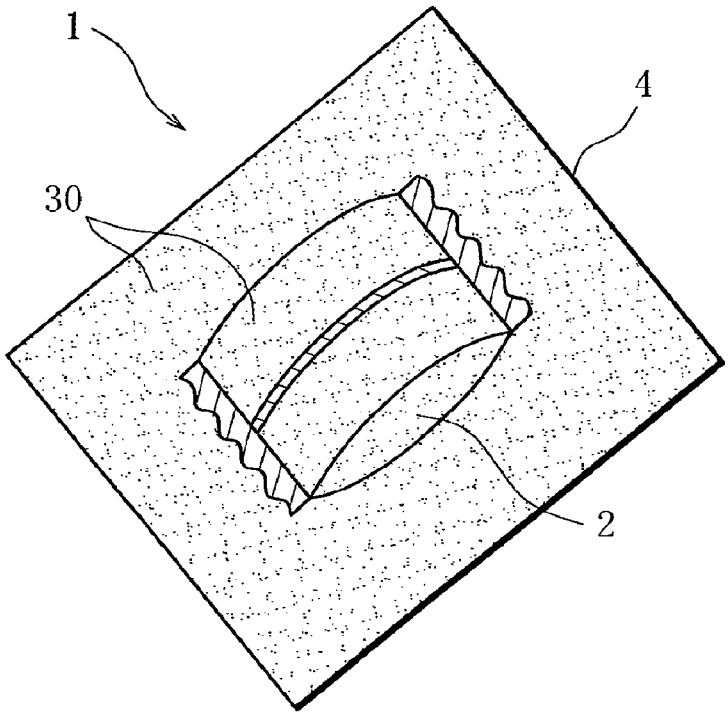
FIG. 1 is a schematic view of an oral tobacco product according to one embodiment of the present invention, illustrating a tobacco pouch and an outer wrapper for wrapping the tobacco pouch therein.

An oral tobacco product 1 illustrated in FIG. 1 has a generally rectangular tobacco pouch 2 and an outer wrapper 4 for individually wrapping the tobacco pouch 2 therein. In FIG. 1, the outer wrapper 4 is still in the form of a rectangular sheet with the tobacco pouch 2 not yet wrapped therein.

The tobacco pouch 2 includes tobacco particles obtained by shredding or pulverizing a tobacco material to a particle size of 2 mm or less, and a pouch wrapper wrapping the tobacco particles therein. The pouch wrapper has liquid permeability. Specifically, the pouch wrapper is made of a sheet of nonwoven fabric and wraps the tobacco particles in a packaging form called pillow wrapping.

The tobacco pouch 2 is put in the user's mouth to allow the user to take in the tobacco components of the tobacco particles via saliva. Specifically, the tobacco pouch 2 is inserted between the upper lip and the gum of the user so that the tobacco components dissolving into the saliva may be taken into the body through the gum. Since the tobacco pouch 2 is used in this manner, the user can take in the tobacco components and enjoy the flavor of the tobacco particles without any smoke emitted from the tobacco pouch 2 or from the user. Consequently, the user can use the tobacco pouch 2 regardless of where he or she is.

In order to permit the tobacco components to easily dissolve into the saliva, the tobacco particles contained in the tobacco pouch 2 have a water content higher than that of the shredded tobacco in ordinary cigarettes. Thus, while the tobacco pouch 2 is kept in storage, water containing the tobacco components of the tobacco particles is liable to ooze to the outer surface of the tobacco pouch 2. Such ooze discolors the outer surface of the tobacco pouch 2, making the tobacco pouch 2 poor-looking. Further, the oozed tobacco components adhere to the user's fingers if the user directly touches the tobacco pouch 2.

The oral tobacco product 1 of the present invention is free from such inconveniences since the tobacco pouch 2 is individually wrapped in the outer wrapper 4 having liquid impermeability. Specifically, the outer wrapper 4 is made of a sheet material, preferably, aluminum-deposited paper, for example. The aluminum-deposited paper includes base paper and an aluminum film deposited on a surface of the base paper by vapor deposition. The aluminum film prevents the water containing the tobacco components oozing out of the tobacco pouch 2 from leaking to the outside of the outer wrapper 4, thereby not only keeping the water content of the tobacco pouch 2 constant but also preventing the flavor of the tobacco components from being dissipated to outside through the outer wrapper 4.

For the sheet material for making the outer wrapper 4, waxed paper or laminated paper may be used in place of the aluminum-deposited paper. The laminated paper includes two paper layers forming opposite sides thereof, and a shielding layer sandwiched between the paper layers and serving to block passage of moisture as well as the flavor therethrough. Specifically, the shielding layer is made of paraffin wax, for example.

Further, at least one of the outer surface of the tobacco pouch 2 and the outer wrapper 4 may contain a food flavor 30.

Specifically, for the food flavor 30, menthol, mint, vanilla, apricot, tea, cocoa, licorice, honey and the like may be used singly or in combination according to the needs of users. The food flavor 30 may, however, not impair the aroma or taste of the tobacco particles, and also since the tobacco particles are alkaline, the food flavor 30 is desirably neutral or alkaline. The food flavor 30 is used in powder form or in the form of a liquid obtained by dissolving the food flavor 30 in a solvent. As the solvent, water, alcohol, glycerin, propylene glycol or the like may be used.

Further, the food flavor 30 is preferably used together with a humectant such as glycerin, propylene glycol or the like.

Referring now to FIGS. 2 to 7, oral tobacco products provided with outer wrappers 4 of various wrapping types will be explained.

Figure 2:
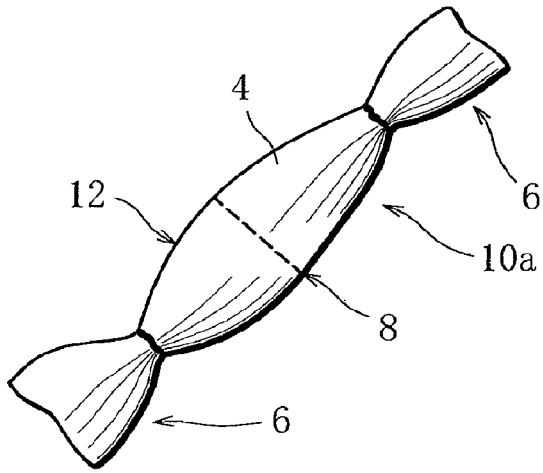
FIG. 2 schematically illustrates a twist wrapping type outer wrapper as one packaging form.
Figure 3:
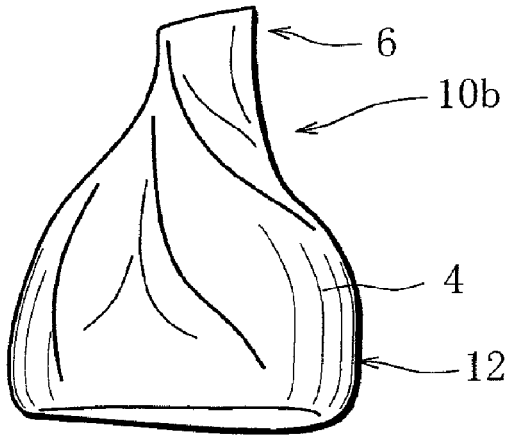
FIG. 3 schematically illustrates another twist wrapping type outer wrapper as the packaging form.

FIGS. 2 and 3 illustrate oral tobacco products 10*a* and 10*b*, respectively, of which the packaging form of the outer wrapper 4 is classified as twist wrapping type.

The outer wrapper 4 of FIG. 2 has a tubular outer covering portion 12 wrapping the tobacco pouch 2 therein, and a pair of twisting portions extending from the outer covering portion 12. To form the outer wrapper 4 shown in FIG. 2, first, a sheet of the outer wrapper 4 is wound around the tobacco pouch 2. At this time, the sheet of the outer wrapper 4 is wound around the tobacco pouch 2 so that the rolled sheet may have opposite end portions projecting from the tobacco pouch 2 and have side edge portions superimposed one upon the other. Subsequently, the opposite end portions of the rolled sheet are twisted in opposite directions at locations near the tobacco pouch 2, thus forming the outer covering portion 12 and a pair of twists. The twists provide the outer wrapper 4 with a pair of lugs 6.

Further, the outer wrapper 4 may have a row of perforations 8 formed in the outer covering portion 12. The perforation row 8 is located in the center of the outer covering portion 12 and extends over an entire circumference or part of the circumference of the outer covering portion 12. Where the outer wrapper 4 is provided with the perforation row 8, the user may hold the pair of lugs 6 with his/her fingers and then pull the lugs 6 outward in opposite directions, whereupon the outer wrapper 4 is torn along the perforation row 8, enabling the user to take out the tobacco pouch 2 with ease from the outer wrapper 4. Thus, when taking out the tobacco pouch 2 from the outer wrapper 4, the user need not twist the lugs 6 in opposite directions.

The outer wrapper 4 illustrated in FIG. 3 has the outer covering portion 12 wrapping the tobacco pouch 2 therein, and a twisting portion projecting from the outer covering portion 12. To form the outer wrapper 4 shown in FIG. 3, first, the tobacco pouch 2 is placed on a sheet of the outer wrapper 4. With the tobacco pouch 2 thus placed, the outer peripheral edge portions of the sheet are raised and gathered above the tobacco pouch 2 and the gathered portions are twisted, thus forming the outer covering portion 12 and a twist. This twist also provides the outer wrapper 4 with a lug 6.

The outer wrapper 4 of FIG. 3 is opened by twisting the lug 6 in the opposite direction, and thus the user can easily take out the tobacco pouch 2 from the outer wrapper 4. Also, the outer wrapper 4 of FIG. 3 can be used to wrap the used tobacco pouch 2 therein. The user can therefore discard the used tobacco pouch 2 without his/her fingers stained.

Figure 4:
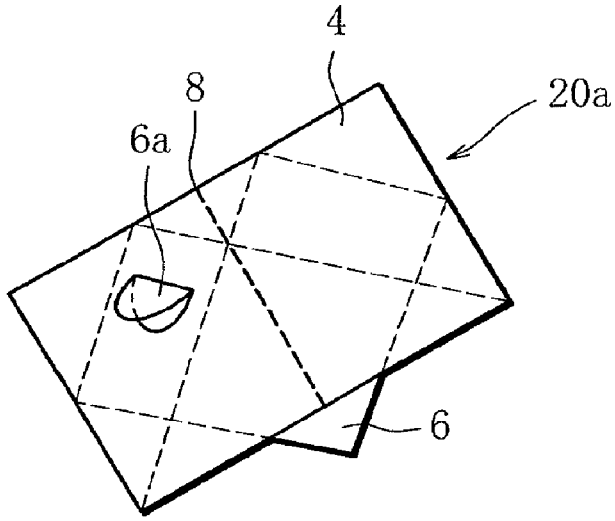
FIG. 4 schematically illustrates a fold wrapping type outer wrapper as the packaging form.
Figure 5:
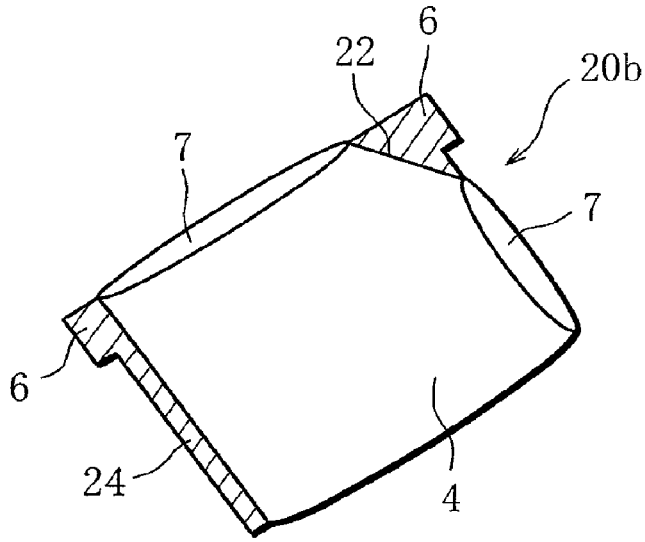
FIG. 5 schematically illustrates a pillow wrapping type outer wrapper as the packaging form.

FIGS. 4 and 5 illustrate oral tobacco products 20*a* and 20*b*, respectively, of which the packaging form of the outer wrapper 4 is classified as fold wrapping type.

The outer wrapper 4 illustrated in FIG. 4 is generally in the form of a rectangular parallelepiped similar to the tobacco pouch 2 and is formed by folding a substantially square sheet around the tobacco pouch 2. Specifically, the square sheet is first folded along a diagonal line, thus obtaining a double triangular sheet whose base is formed by the diagonal line. The tobacco pouch 2 is inserted in the double triangular sheet. Subsequently, the opposite side portions of the triangular sheet are alternately folded in along respective two trisection lines trisecting the base of the triangular sheet, thus forming two small triangular pieces alternately superimposed on the remainder of the triangular sheet.

In this manner, the double triangular sheet is formed into an intermediate of the outer wrapper 4. The intermediate is in the form of a pentagon having an apex constituted by the apex of the triangular sheet and a superimposed base obtained by superimposing the trisected parts of the base of the triangular sheet. In the pentagonal intermediate, the superimposed base subtends the apex.

Further, the apex-side portion of the intermediate is folded along a line parallel with the superimposed base and located closer to the superimposed base than the middle between the angular point of the apex and the superimposed base is, and is superimposed on the remainder of the intermediate, whereupon the intermediate is formed into the outer wrapper 4. In the outer wrapper 4 thus obtained, the apex portion of the intermediate projects from the superimposed base and provides the outer wrapper 4 with a lug 6.

Where the apex-side portion constitutes an obverse of the outer wrapper 4, a raised piece formed by a U-shaped slit, that is, a pull-up tab, may be formed on the obverse side of the outer wrapper 4. The pull-up tab also provides the outer wrapper 4 with a lug 6*a*.

Further, the outer wrapper 4 may have a perforation row 8 formed in a reverse surface thereof. By tearing the outer wrapper 4 along the perforation row 8, the user can take out the tobacco pouch 2 with ease from the outer wrapper 4. In FIG. 4, the lug 6*a* is indicated by solid lines for the sake of convenience of illustration.

The packaging form of the outer wrapper 4 illustrated in FIG. 5 is classified as pillow wrapping type. Specifically, a sheet of the outer wrapper 4 is folded in two to wrap the tobacco pouch 2 therein. The outer wrapper 4 does not have a longitudinal seal and has lateral seals only, namely, a top seal 22 and a bottom seal 24. As is clear from FIG. 5, the bottom seal 24 extends over an entire width of the bottom of the outer wrapper 4, but the top seal 22 is formed only at one corner of the top of the outer wrapper 4. Because of the top seal 22, two openings 7 are formed which are located at one side edge and the top of the outer wrapper 4, respectively, and which have sizes small enough to prevent the tobacco pouch 2 from slipping out therethrough.

Further, the outer wrapper 4 has two lugs 6 formed at the top and bottom seals 22 and 24, respectively.

Figure 6:
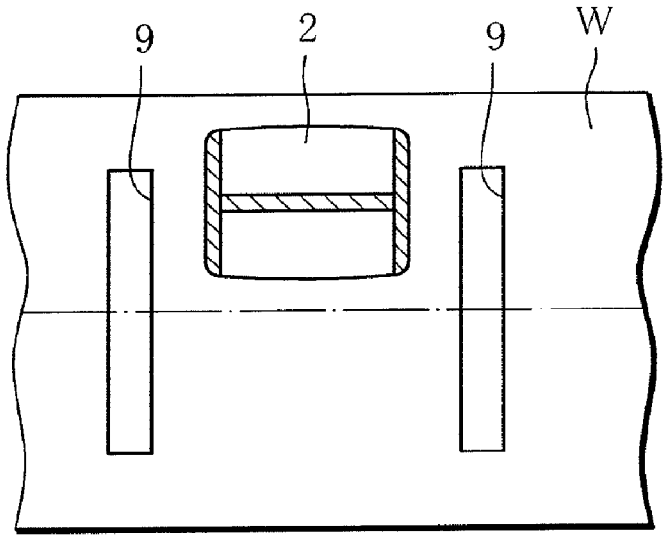
FIG. 6 is a schematic diagram illustrating a former half of a process for forming the outer wrapper of FIG. 5.
Figure 7:
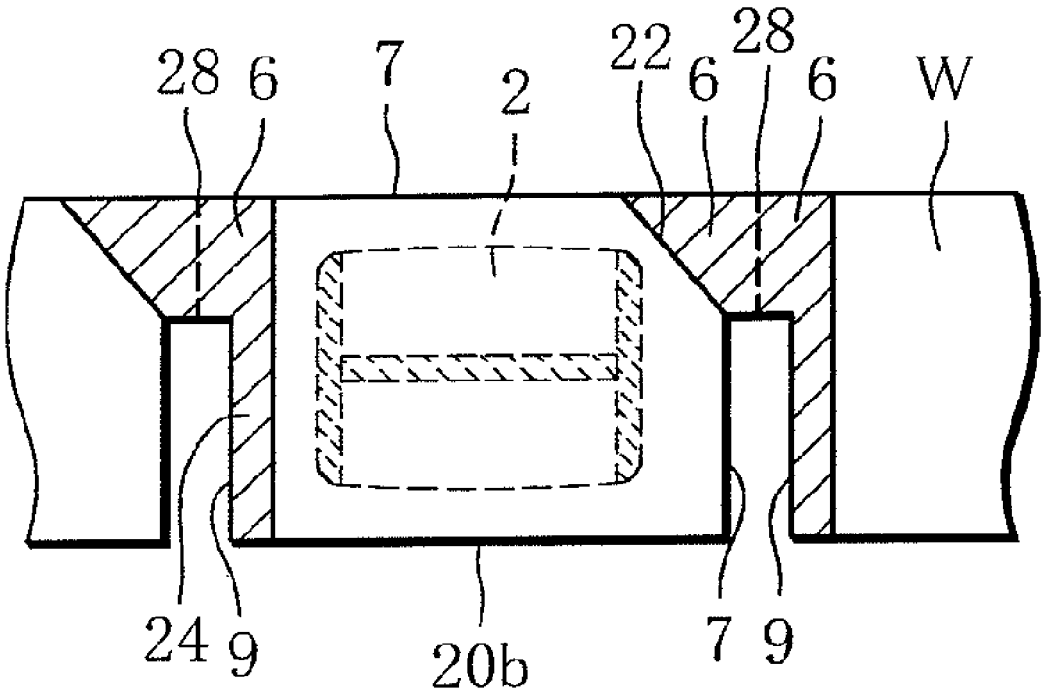
FIG. 7 is a schematic diagram illustrating a latter half of the process.

FIGS. 6 and 7 illustrate a procedure for manufacturing the oral tobacco product 20*b* shown in FIG. 5.

A web W for forming the outer wrapper 4 has a width large enough to wrap the tobacco pouch 2 therein and has rectangular slots 9 each cut in a central region of the web W and extending in the width direction. The slots 9 are arranged at regular intervals in the longitudinal direction of the web W.

As illustrated in FIG. 7, the tobacco pouch 2 is inserted in the doubly folded web W so as to be located between adjacent two of the slots 9.

The doubly folded web W is then laterally sealed, whereupon the top seal 22 and the bottom seal 24 are formed at the same time. Subsequently, the doubly folded web W is cut along cutting lines 28, thereby obtaining individual oral tobacco products 20*b*.

A procedure for manufacturing the oral tobacco product 1 will be now described with reference to the block diagram of FIG. 8.

Figure 8:
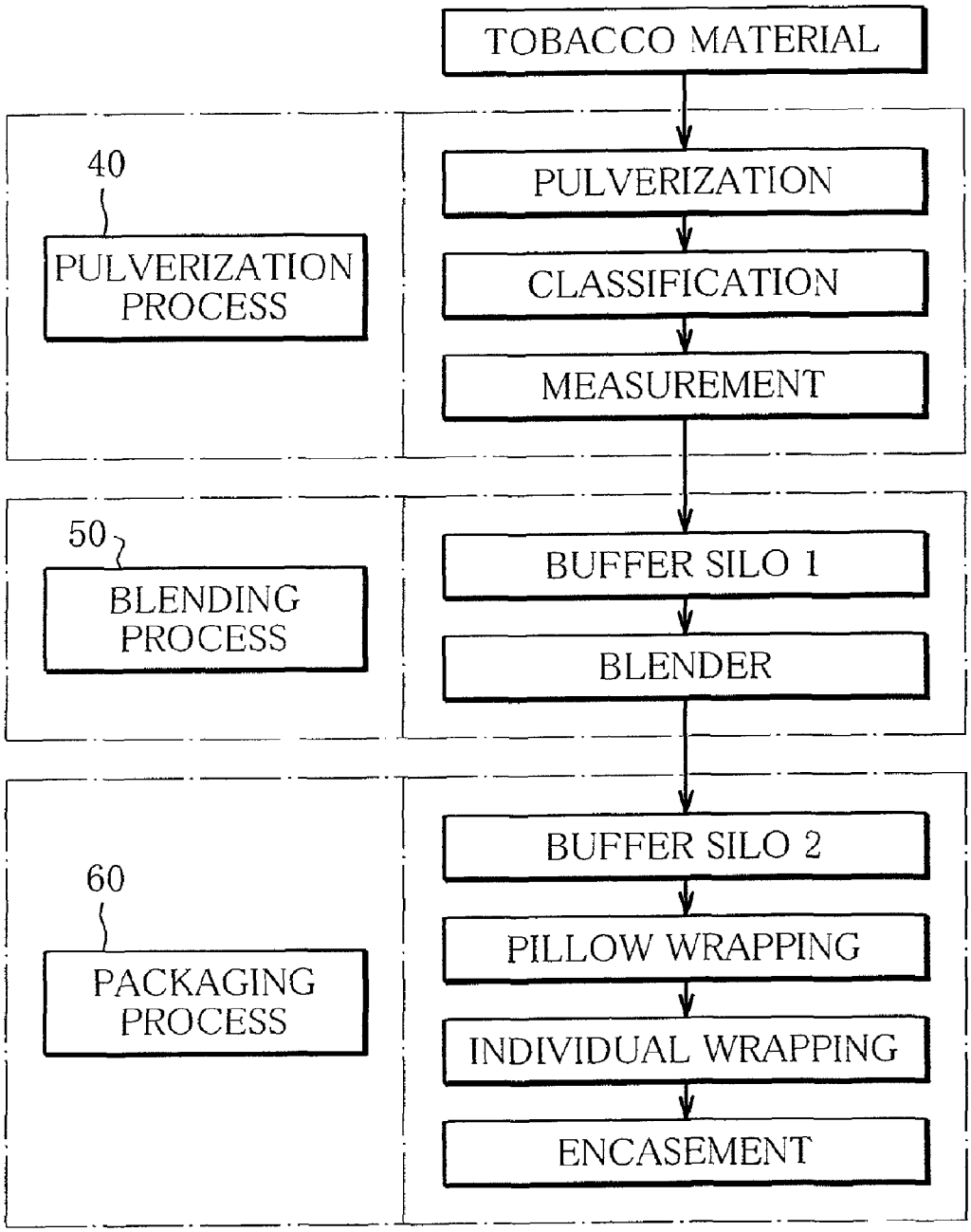
FIG. 8 is a block diagram illustrating a procedure for manufacturing the oral tobacco product.

As illustrated in FIG. 8, the oral tobacco product 1 is manufactured by a pulverization process 40, a blending process 50, and a packaging process 60.

First, in the pulverization process 40, the laminas and midribs of domestic Burley tobacco are separately pulverized by respective pulverizers, to obtain tobacco particles with a particle size of 2 mm or less. The tobacco particles are then put in respective classifiers to be classified according to size. Subsequently, the tobacco particles obtained from the laminas and those obtained from the midribs are measured such that each accounts for 50 weight %, and are sent to the blending process 50.

In the blending process 50, the tobacco particles, which have been subjected to the measurement, are conveyed to a buffer silo 1 and kept in the silo 1 for a predetermined period of time. Then, the tobacco particles in the buffer silo 1 are subjected to thermal sterilization and cooling and are blended by a blender. While the tobacco particles are mixed by the blender, a flavoring agent and the like are added to the tobacco particles.

Specifically, in the blending process, water is first added to the tobacco particles so that the tobacco particles may have a water content adjusted to 15 weight %. Subsequently, the tobacco particles are heated at 100° C. for four hours, that is, sterilization is performed. On completion of the sterilization, the tobacco particles are cooled by means of circulating cooling water, and then 10 weight % of potassium carbonate, 1 weight % of vitamin C, 5 weight % of flavoring agent, sodium chloride and the like are added as additives to the tobacco particles.

The additives and the tobacco particles are mixed together to obtain a mixture containing the tobacco particles as a main component. The mixture is then sent to the packaging process 60. The tobacco particles in the mixture preferably have a pH falling within a range of 6.5 to 9.5.

The packaging process 60 includes storage in a buffer silo 2 where the mixture obtained by the blending process 50 is stored for a predetermined period of time.

After the storage, 0.3 g of the mixture is wrapped in the form of a pillow by using a sheet of nonwoven fabric, thus obtaining the aforementioned tobacco pouch 2. Specifically, the tobacco pouch 2 is in the form of a rectangle of about 12 mm×25 mm.

Subsequently, water is added to each tobacco pouch 2 so that the water content may be adjusted to 25 weight %, and the tobacco pouches 2 are individually wrapped in aluminum-deposited paper, thus obtaining the oral tobacco products 1. The oral tobacco products 1 thus obtained have any one of the packaging forms categorized as the twist wrapping types or the fold wrapping types, illustrated in FIGS. 2 to 5, and a predetermined number of the oral tobacco products are contained in a case.

In the case of manufacturing the oral tobacco product 1 in which the food flavor is added to the outer surface of the tobacco pouch 2 or to the inner surface of the outer wrapper 4 as stated above, a nonwoven fabric sheet or outer wrapper 4 previously admixed with the food flavor may be used. In this case, glycerin, which also functions as a humectant, is preferably spray-coated on the tobacco pouch 2 in an amount of 1% by weight of the food flavor.

Thus, in the oral tobacco product 1, the tobacco pouch 2 is individually wrapped in the outer wrapper 4, and therefore, when using the oral tobacco product 1, the user can hygienically take out the tobacco pouch 2 from the case without his/her fingers stained with the tobacco components that may have oozed to the outer surface of the tobacco pouch 2. Also, such ooze of the tobacco components does not appear on the outer surface of the outer wrapper 4, making the oral tobacco product 1 look nice.

Further, the outer wrapper 4 serves to prevent evaporation of the flavor and water contained in the tobacco particles, whereby the quality of the tobacco particles can be maintained. When the used tobacco pouch 2 is discarded, moreover, the outer wrapper 4 can be used to wrap the used tobacco pouch 2.

The present invention is not limited to the foregoing embodiments alone and may be modified in various ways.

For example, the manner of how the tobacco pouch 2 is individually wrapped in the outer wrapper 4 is not limited to the aforementioned forms, and any desired packaging form may be employed insofar as the outer wrapper 4 can conceal oozed tobacco components and also can be easily removed when the tobacco product 1 is used.

Also, the shape of the lug 6 is not limited to the illustrated shapes, and the lug 6 may have any desired shape insofar as the user can hold the lug 6 with his/her fingers.

Furthermore, the outer wrapper 4 may have information printed on its outer surface.

EXPLANATION OF REFERENCE SIGNS

1 oral tobacco product
2 tobacco pouch
4 outer wrapper
6, 6*a* lug
7 opening
8 perforation row
9 slot
10 twist wrapping type tobacco product
12 outer covering portion
20 fold wrapping type tobacco product
22 top seal
24 bottom seal
28 cutting line
30 food flavor
40 pulverization process
50 blending process
60 packaging process
W web

The invention claimed is:

1. An oral tobacco product comprising:

a tobacco pouch including tobacco particles made from a tobacco material, and a wrapper wrapping the tobacco particles therein, said tobacco pouch allowing a user to take in tobacco components of the tobacco particles via saliva when put in the user's mouth; and an outer wrapper individually wrapping said tobacco pouch therein, wherein said outer wrapper is made of one of aluminum-deposited paper, laminated paper, and waxed paper so that said outer wrapper has liquid impermeability, and said outer wrapper includes two openings having a size smaller than that of said pouch and two lugs;

said outer wrapper has the shape of a pillow and has two longitudinal side edges and two lateral side edges; and one of the longitudinal side edges and one of the lateral side edges are opened as said openings.

2. The oral tobacco product according to claim 1, wherein said outer wrapper has a packaging form of fold wrapping type.

3. The oral tobacco product according claim 1, wherein the first lug of two lugs is located at a corner defined between the one longitudinal side edge and the one lateral side edge, the lug protruding from the one lateral side edge.

4. An oral tobacco product according to claim 3 wherein the second lug of two lugs is at a corner defined between the one longitudinal side edge and the other lateral side edge, the second lug protruding from the other lateral side edge.

5. The oral tobacco product according to claim 1, wherein the tobacco pouch and/or the outer wrapper contains a food flavoring product.

6. The oral tobacco product according to claim 5, wherein the tobacco pouch and/or the outer wrapper contains a humectant.

* * * * *